US005794098A

United States Patent [19]

Folkins

[11] Patent Number: 5,794,098

[45] Date of Patent: Aug. 11, 1998

[54] LEADING EDGE ELECTROSTATIC VOLTMETER READINGS IN THE IMAGE-ON-IMAGE ELECTROPHOTOGRAPHIC PRINTING PROCESS

[75] Inventor: Jeffrey J. Folkins, Rochester, N.Y.

[73] Assignee: Xerox Corporation, Stamford, Conn.

[21] Appl. No.: 734,142

[22] Filed: Oct. 21, 1996

[51] Int. Cl.[6] ..... G03G 15/02

[52] U.S. Cl. ..... 399/50; 399/51

[58] Field of Search ..... 399/38, 39, 40, 399/46, 49, 48, 50, 73, 168, 169, 296

[56] References Cited

U.S. PATENT DOCUMENTS

| | | | |
|---|---|---|---|
| 4,990,955 | 2/1991 | May et al. | 399/40 |
| 5,534,977 | 7/1996 | Saitoh et al. | 399/50 |
| 5,666,590 | 9/1997 | Folkins | 399/50 X |

*Primary Examiner*—Arthur T. Grimley
*Assistant Examiner*—Hoan Tran
*Attorney, Agent, or Firm*—John M. Kelly

[57] ABSTRACT

Method and apparatus for implementing discharge and develop, REaD IOI electrostatic printing machines that determine image area charge potentials of without using potentials within interdocument zones. The method includes charging a photoreceptor's image area to a charge potential, interrogating the image data to be used to produce a latent image on that charged image area to identify a white section, exposing the charged image area according to the image data to form a latent image, determining the potential of the white section of the latent image, and equating the potential of the white section to the charge potential. The printing machine includes a photoreceptor having a charge retentive surface of a sufficient length to hold a plurality of image areas; a charging station charging one image area to a potential that is to be determined; an image data source producing a digital representation of a latent image that is to be produced; an exposure station exposing the image area to produce a latent image; a data interrogator for identifying white sections; and an electrostatic voltmeter for measuring the potential of the identified white area.

2 Claims, 2 Drawing Sheets

LEADING EDGE ELECTROSTATIC VOLTMETER READINGS IN THE IMAGE-ON-IMAGE ELECTROPHOTOGRAPHIC PRINTING PROCESS

FIELD OF THE INVENTION

This invention relates to image-on-image electrophotographic printers, in particular it relates to the use of electrostatic voltmeters in such printers.

BACKGROUND OF THE INVENTION

Electrophotographic printing is a well known method of producing documents. That method is typically performed by exposing a substantially uniformly charged photoreceptor with a light image representation of a desired document. In response to the exposing light, the photoreceptor discharges so as to create an electrostatic latent image of the desired document on the photoreceptor's surface. Toner particles are then deposited onto the latent image to form a toner image. That toner image is then transferred from the photoreceptor, either directly or after an intermediate transfer step, onto a substrate such as a sheet of paper. The transferred toner image is then permanently fused to the substrate using heat and/or pressure, thus producing the desired document. The surface of the photoreceptor is then cleaned of residual developing material and recharged in preparation for the creation of another image.

The process described above can be modified to produce color images. In one color printing process, which may be referred to as the multipass intermediate belt process, a first toner layer is produced using a first color of toner, that first toner layer is then transferred onto an intermediate belt, then a second toner layer is developed using a second color of toner, and that second toner layer is then transferred onto the intermediate belt in superimposed registration with the first toner layer. The process then repeats for third and fourth toner layers which are comprised of third and fourth colors of toner. After all of the toner layers are transferred to the intermediate belt a composite toner image results. That composite toner image is then transferred and fused onto a substrate.

In the multipass intermediate belt process the development of each toner layer is essentially independent of the development of the other toner layers. This is beneficial since the developing stations can be set up to produce the desired target toner masses for each color of toner independent of the other developing stations.

Another color electrophotographic printing process, referred to herein as the REaD IOI process (which stands for the Recharge, Expose, and Develop, Image-On-Image process) the various toner images are developed in a superimposes relationship on the photoreceptor itself. Only after the composite toner image is formed are the toner layers transferred off of the photoreceptor. While the REaD IOI process is beneficial in that eliminating the toner transfers between developing and exposure can reduce costs, increase the throughput of the printing process, and reduce the size of the resulting printer, it has several drawbacks. For example, exposing the photoreceptor after a previous toner image has been developed on it is relatively difficult since the exposing light must expose an image through an existing toner layer.

One significant issue when implementing the REaD IOI process is achieving the proper charge voltage on the photoreceptor. To optimize for best print image quality it is common to implement the REaD IOI process such that the photoreceptor is uniformly charged to different charge levels before each exposure. Typically, the voltage on a photoreceptor is designed as $V_{ddp}$ (a term of art often referred to as the dark decay potential). For example, a prototypical system might have a $V_{ddp}$ of 400 volts before exposing the photoreceptor and developing a black toner layer, a $V_{ddp}$ of 300 volts before exposing the photoreceptor (and its existing black toner layer) and developing a yellow toner layer, a $V_{ddp}$ of 350 volts before exposing the photoreceptor (and its two toner layers) and developing a magenta toner layer, and a $V_{ddp}$ of 450 volts before exposing the photoreceptor (and its three existing toner layers) and developing a cyan toner layer. The cited values are typical of those found in discharge area development (DAD) systems. In discharge area development the sections of the photoreceptor that are actually exposed (and thus discharged) by the light source are developed. However, in practice, specific $V_{ddp}$ values are determined by system electronics in response to many factors, such as humidity, temperature, the aging of the light source, the characteristics of the photoreceptor, and the developers that are used.

But whatever the determined values of $V_{ddp}$ are, it is important that the charger(s) that charge(s) the photoreceptors actually charge the photoreceptor to the determined values. To verify the value of $V_{ddp}$ it is common practice to insert an electrostatic voltmeter adjacent the photoreceptor. The electrostatic voltmeter actually reads the voltage on the photoreceptor. If the actually value of $V_{ddp}$ is below the desired value the system electronics will increase the charge applied to the photoreceptor. Alternatively, if the actually value of $V_{ddp}$ is above the desired value the system electronics will decrease the charge applied to the photoreceptor.

To assist the understanding of the present invention several things should be further described and highlighted. First, electrophotographic printing machines usually use a photoreceptor that has a surface area that is longer than the latent image being produced. Indeed, often a photoreceptor is long enough to hold two or more latent images. If the photoreceptor holds two latent images it is typical to say that the printing machine has a pitch of two, if the photoreceptor holds three latent images the printing machine has a pitch of three, and so on. In practice, to avoid overlap and contamination of the images, the individual latent image areas are separated by a distance called the interdocument zone. In most prior electrophotographic printers, particularly those that use the multipass intermediate belt process, either a photoreceptor only had one latent image at a time, or the interdocument zone was sufficient to permit an electrostatic voltmeter to determine the voltage on the photoreceptor by reading the voltage in the interdocument zone.

Note that if the electrostatic voltmeter was placed so as to take a reading prior to image exposure that the $V_{ddp}$ could be read at any point within the latent image or with the interdocument zone. However, in most electrophotographic printing machines the electrostatic voltmeter is placed after the image exposure step—in part to enable the measurement of the photoreceptor voltage after exposure and in part to allow the electrostatic voltmeter to be placed as close to the developer housing as possible so as to increase the accuracy of the $V_{ddp}$ reading. Hence in those machines reading $V_{ddp}$ was performed in the interdocument zone.

However, in electrophotographic printing machines that use the REaD IOI process it is common to have the photoreceptor hold a plurality of closely spaced latent images/toner layers. Indeed, the closer the latent images are spaced, or in other words the smaller the interdocument zone, the more compact the photoreceptor can be. Compact photoreceptors permit compact printing machines, which enables reduced cost and smaller foot prints. Therefore, it is desirable to reduce the interdocument zone, say to the order of 10's of millimeters. Significantly, charging systems usually include a scorotron, a device that has a width of 10's of millimeters, to charge the photoreceptor. Furthermore, since a scorotron's charging voltage usually changes within an interdocument zone in response to different colors being imaged, and since the resultant voltage transition takes place over a distance that is similar in dimension to an interdocument zone, an accurate electrostatic voltmeter reading cannot be made within a small interdocument zone. The result is that printing systems that read the photoreceptor voltage within a interdocument zones are limited by the minimum size of the interdocument zones that they can have.

Therefore, a technique of determining a photoreceptor's potential without reading the potential within the interdocument zone would be beneficial.

SUMMARY OF THE INVENTION

The principles of the present invention provide for discharge and develop REaD 101 electrostatic printing machines that determine charge potentials of image areas without always reading that potential within interdocument zones. A method according to the principles of the present invention includes charging a photoreceptor's image area to a charge potential, interrogating the image data to be used to produce a latent image on that charged image area so as to identify a white section, exposing the charged image area according to the image data to produce a latent image, determining the potential of the white section of the latent image, and equating the potential of the white section to the charge potential. Beneficially, the method further includes the step of charging the photoreceptor so as to cause the potential of white sections of subsequent images to have a predetermined value.

A printing machine according to the principles of the present invention is comprised of a photoreceptor; a first charging station for charging one image area to a potential that is to be determined; an image data source for producing a digital representation of a latent image that is to be produced on said image area; an exposure station for exposing said one image area with said digital representation so as to produce a latent image; a data interrogator for examining said digital representation so as to identify a white area; and an electrostatic voltmeter for measuring the potential of said white area, wherein said potential of said white area is equated to the potential that is to be determined. Beneficially, the charging station further includes an error correcting network that receives the measurement of the potential that is to be determined and that adjusts the charge on subsequent image areas such that the charge on the one image area is at a predetermined magnitude.

BRIEF DESCRIPTION OF THE DRAWINGS

Other aspects of the present invention will become apparent as the following description proceeds and upon reference to the drawings, in which.

DETAILED DESCRIPTION OF THE PREFERRED EMBODIMENTS

The preferred embodiment of the present invention includes a plurality of individual subsystems which are known in the prior art, but which are organized and used so as to produce a composite color image. While the illustrated embodiment is based upon a 5 pass (or 5 cycle) color electrophotographic printing machine, see the printing machine 8 shown in FIG. 1, the present invention is not limited to such embodiments. For example, and without limitation, the principles of the present invention can be used with 4 pass printing machines. Therefore, it is to be understood that the present invention is intended to cover all alternatives, modifications and equivalents as may be included within the scope of the appended claims.

Figure 1:
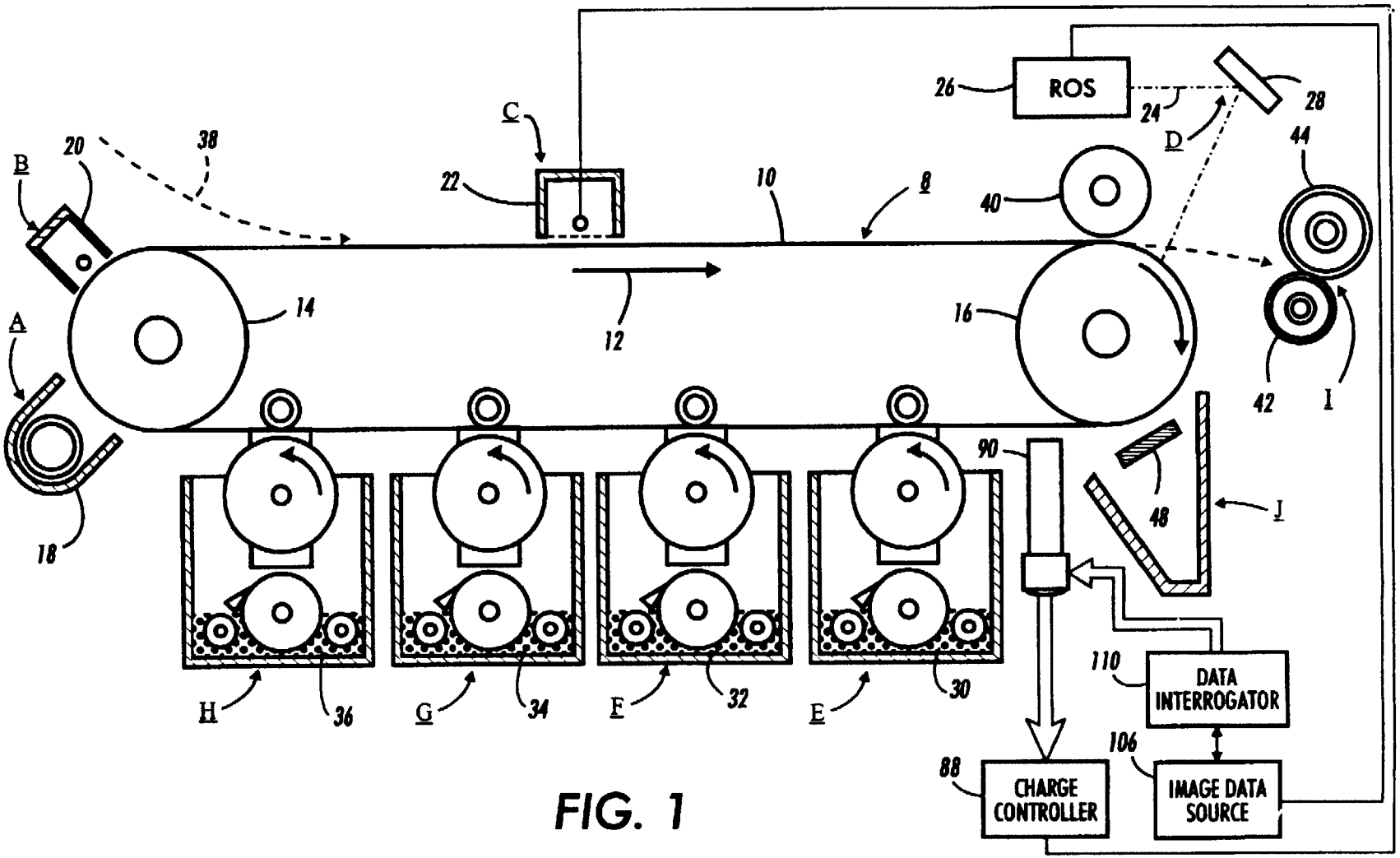
FIG. 1 is a schematic illustration of an electrophotographic printing machine which incorporates the principles of the present invention.

FIG. 1 illustrates a discharge-area-development, recharge-expose-and develop, image-on-image, color, electrophotographic printing machine 8 which is suitable for implementing the principles of the present invention. U.S. patent application Ser. No. 08/472,164, entitled "FIVE CYCLE IMAGE ON IMAGE PRINTING ARCHITECTURE," which was filed on Jun. 7, 1995 and which is hereby incorporated by reference, provides further information related to this type of printing machine.

Figure 2:
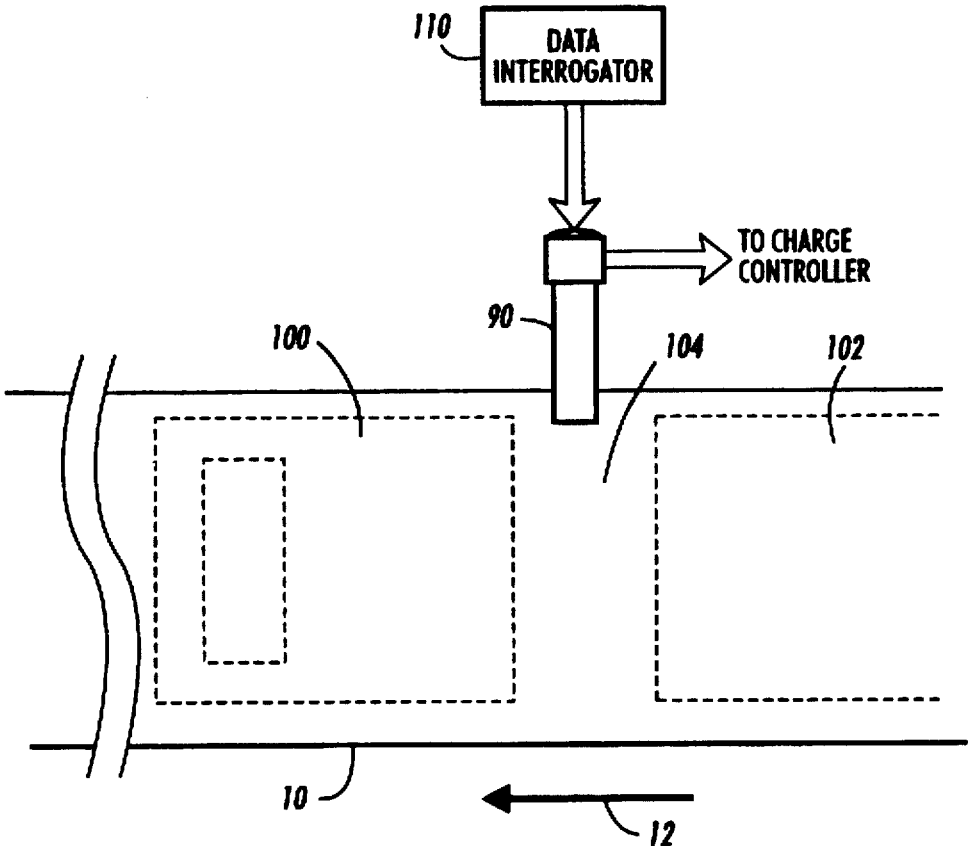
FIG. 2 presents a schematic view of the spatial relationship of key components of the electrophotographic printing machine according to FIG. 1.

The printing machine 8 includes an Active Matrix (AMAT) photoreceptor belt 10 which travels in the direction indicated by the arrow 12. Belt travel is brought about by mounting the belt about a tension roller 14 and a drive roller 16 (which is driven by a motor which is not shown). As the photoreceptor belt travels each part of it passes through each of the subsequently described process stations. For convenience, a single section of the photoreceptor belt, referred to as an image area, is identified. The image area is that part of the photoreceptor belt that is to be exposed and developed, as subsequently explained, to produce a composite image. Turning now to FIG. 2, it is to be understood that the photoreceptor belt 10 includes more than one image area. For example, FIG. 2 shows a first image area 100 and a second image area 102 that are separated by an interdocument zone 104. The other components illustrated in FIG. 2 are described subsequently.

Turning back to FIG. 1, a first cycle begins with an image area passing through an erase station A. For convenience, it will be assumed that it is the image area 100 that is passing through the erase station A. At erase station A an erase lamp 18 illuminates the image area 100 so as to cause any residual charge which might exist on image area 100 to be discharged. Such erase lamps and their use in erase stations are well known. Light emitting diodes are commonly used as erase lamps.

As the photoreceptor belt continues its travel the image area 100 passes through a first charging station B (and the image area 102 advances to the erase station A for erasure as described above). At the first charging station B a corona generating device 20, beneficially a DC pin scorotron, charges the image area to a relatively high and substantially uniform potential of, for example, about −450 volts. After passing the corona generating device 20 the image area 100 passes through a second charging station C which partially discharges the image area 100 to, for example, about −400 volts. The second charging station C uses an AC scorotron 22 to generate the required ions. Controlling the charge from the scorotron, and thus the potential of the image area 100, is a charge controller 88. The operation of the charge controller is described in more detail subsequently.

The use of a first charging station to overcharge the image area and a subsequent second charging station to neutralize the overcharge is referred to as split charging. A more complete description of split charging may be found in co-pending and commonly assigned U.S. Patent application, "Split Recharge Method and Apparatus for Color Image Formation," Ser. No. 08/347,617. Since split charging is beneficial for recharging a photoreceptor which has a developed toner layer, and since the image area does not have such a toner layer during the first cycle, split charging is not required during the first cycle. If split charging is not used in the first cycle either the corona generating device 20 or the scorotron 22 corona could be used to simply charge the image area to the desired level of −400 volts.

Returning now to FIG. 1, after passing the second charging station C the image area 100 passes to an exposure station D (and image area 102 passes by the first and second charging stations). At exposure station D the charged image area 100 is exposed by the output 24 of a laser based output scanning device 26 which reflects from a mirror 28. The scanning device discharges some parts of the image area so as to produce an electrostatic latent representation of a first color of image (beneficially black) on the image area 100. The exposed part of the image area might be discharged by the output 24 to about −50 volts. Thus, after exposure the image area will have a voltage profile comprised of sections at a relatively high voltage of about −400 volts and a section at a relatively low voltage of about 50 volts.

The electrostatic latent image produced on the image area 100 is derived from information that represents one color of image from an image data source 106. That data source might be an input scanner, a computer, a facsimile machine, a memory device, or any of a number of other image data source. As in the prior art, the image data for the latent image modulates the ROS intensity to produce the electrostatic latent image. In addition to the image data source 106, the printing machine 8 includes an data interrogator 110. The image interrogator searches the image data in the image data source so to identify solid sections of sufficient size of unexposed areas of the image area 100. By solid sections it is meant areas of the image area that are not exposed. Typically, a solid section exists on the leading edge of an image area, the section that corresponds to a top margin of a document. Other solid sections may exist in areas that correspond to the bottom margin of a document or in areas that are left blank. The data interrogator outputs a read signal when solid sections occur in an image area.

Referring now to both FIGS. 1 and 2, after passing through the exposure station D the exposed image area advances past an electrostatic voltmeter 90 (and the image area 102 advances through the exposure station D) that reads the potential of the photoreceptor belt 10. The electrostatic voltmeter is synchronized with read signals such that after the occurrence of a read signal, plus the time required for the solid area that initiated that read signal to advance to the electrostatic voltmeter, that the electrostatic voltmeter reads the potential of the solid region. Since the solid region has substantially the same charge potential as the charging voltage of the charging station C, the electrostatic voltmeter reading corresponds to the charging voltage of the charging station C. That reading is then applied to the charging controller 88. If the electrostatic voltmeter reading is less than a predetermined voltage, the charging controller increases the charge on the next image area that is to be exposed to produce a first (black) latent image. Conversely, if the electrostatic voltmeter reading is more than the predetermined voltage, the charging controller decreases the charge on the next image area that is to be exposed to produce a first (black) latent image.

The foregoing describes a feedback system wherein a potential being controlled, that being the charge on a subsequent image area, is sensed by measuring the potential on non-exposed (solid) regions of a previous image area. This is advantageous in that the interdocument zone 104 (see FIG. 2) can be minimized.

Returning now to FIG. 1, after the image area 100 advances past the electrostatic voltmeter 90, it passes a first development station E. The first development station E contains a toner 30 of a first color, beneficially black. Black is beneficial since the subsequently described colored toner particles are not normally written over black toner, and therefore residual toner voltages are not a problem over black toner. While the first development station E could be a magnetic brush developer, a scavengeless developer may be somewhat better. Scavengeless development is well known and is described in U.S. Pat. No. 4,984,019 entitled, "Electrode Wire Cleaning," issued Jan. 3, 1991 to Folkins; in U.S. Pat. No. 4,868,600 entitled "Scavengeless Development Apparatus for Use in Highlight Color Imaging," issued Sep. 19, 1989 to Hayes et al.; in U.S. Pat. No. 5,010,367 entitled "Dual AC Development System for Controlling The Spacing of a Toner Cloud," issued Apr. 23, 1991 to Hays; in U.S. Pat. No. 5,253,016 entitled, "Contaminant Control for Scavengeless Development in a Xerographic Apparatus," issued on Oct. 12, 1993 to Behe et al.; and in U.S. Pat. No. 5,341,197 entitled, "Proper Charging of Doner Roll in Hybrid Development," issued to Folkins et al. on Aug. 23, 1994. Those patents are hereby incorporated by reference.

One benefit of scavengeless development is that it does not disturb previously deposited toner layers. Since during the first cycle the image area does not have a previously developed toner layer, the use of scavengeless development is not absolutely required as long as the developer is physically out of contact during other cycles. However, since the other development station (described below) use scavengeless development it may be better to use scavengeless development at each development station.

After passing the first development station E, the image area returns to the first charging station B. The second set-up cycle then begins. The first charging station B uses its corona generating device 20 to overcharge the image area and its first toner layer to more a negative voltage levels than that which they are to have when they are next exposed. For example, the image area and its first toner patch may be charged to a potential of about −350 volts. The image area 100 then advances once again to the second charging station C. The second charging station C reduces the charge on the image area 100, leaving the image area potential at about −300 volts. This split recharging is effective in reducing the residual toner voltage which develops after the second exposure, described below.

After the image area 100 passes the second charging station C, both the first toner layer and the untoned part of the image area advance to the exposure station D. At exposure station D the image area is again exposed to the output 24 of a laser based raster output scanning device 26 that is modulated in accord with image data from the image data source 106. However, during this cycle the scanning device 26 is modulated with information that represents a second color image, say yellow.

After passing through the exposure station D the exposed image area again advances past the electrostatic voltmeter 90. The electrostatic voltmeter is once again synchronized with read signals from the data interrogator such that after the occurrence of a read signal, plus the time required for the identified solid area that initiated that read signal to advance to the electrostatic voltmeter, that the electrostatic voltmeter reads the potential of the solid region. Since the solid region has substantially the same charge potential as the image area did when it passes the charging station C, the electrostatic voltmeter reading corresponds to the charging voltage out of the charging station C. That reading is then applied to the charging controller 88. The charging controller again adjusts charging station C such that a predetermined charge potential is applied to the image area before the second exposure. In general, the charging station C will charge the image area to different potentials in different cycles.

After the image area 100 advances past the electrostatic voltmeter 90 the second time, the latent image is developed at a second development station F. The second development station F contains a toner 32 of a second color, assumed to be yellow. As indicated above, the second development station F beneficially uses a scavengeless developer.

After passing through the second development station F, the image area returns once again to the first charging station B and to the second charging station C. The third cycle then begins. Again, the first charging station B overcharges the image area and its toner layers to more negative voltage levels than that which they are to have when they are next exposed, and the second charging station reduces the charge potential substantially to a predetermined value, say −350 volts.

The recharged image area 100 then passes once again through the exposure station D. At the exposure station D the recharged image area is again exposed to the output 24 of a laser based output scanning device 26. Once again the raster output scanning device 26 is modulated in accord with image data from the image data source 106. However, during this cycle the scanning device 26 is modulated with information that represents a third color image, say magenta. The image area 100 then again passes the electrostatic voltmeter 90. The electrostatic voltmeter is once again synchronized with read signals from the data interrogator 110 such that after the occurrence of a read signal, plus the time required for the identified solid area that initiated that read signal to advance to the electrostatic voltmeter, that the electrostatic voltmeter reads the potential of the solid region. Again since the solid region has substantially the same charge potential as the image area did when it passes the charging station C, the electrostatic voltmeter reading corresponds to the charging voltage out of the charging station C. That reading is once again applied to the charging controller 88, which again adjusts charging station C such that a predetermined charge potential is applied to the image area before the third exposure.

After the image area 100 advances past the electrostatic voltmeter 90 the third time, the latent image is developed at a third development station G. The third development station G contains a toner 34 of a third color, assumed to be magenta. As indicated above, the third development station G beneficially uses a scavengeless developer.

After passing through the third development station G, the image area returns once again to the first charging station B and to the second charging station C. The fourth cycle then begins. Again, the first charging station B overcharges the image area and its toner layers to more negative voltage levels than that which they are to have when they are next exposed, and the second charging station reduces the charge potential substantially to a predetermined value, say −450 volts.

The recharged image area 100 then passes once again through the exposure station D. At the exposure station D the recharged image area is once again exposed to the output 24 of a laser based output scanning device 26. Again the raster output scanning device 26 is modulated in accord with image data from the image data source 106. However, during this cycle the scanning device 26 is modulated with information that represents a fourth color image, say-cyan. The image area 100 then again passes the electrostatic voltmeter 90. The electrostatic voltmeter is once again synchronized with read signals from the data interrogator 110 such that after the occurrence of a read signal, plus the time required for the identified solid area that initiated that read signal to advance to the electrostatic voltmeter, that the electrostatic voltmeter reads the potential of the solid region. Again since the solid region has substantially the same charge potential as the image area did when it passes the charging station C, the electrostatic voltmeter reading corresponds to the charging voltage out of the charging station C. That reading is once again applied to the charging controller 88, which again adjusts charging station C such that a predetermined charge potential is applied to the image area before the fourth exposure.

After the image area 100 advances past the electrostatic voltmeter 90 the fourth time, the latent image is developed at a fourth development station H. The fourth development station H contains a toner 36 of a fourth color, assumed to be cyan. As indicated above, the fourth development station H beneficially uses a scavengeless developer.

After completing the fourth cycle the image area has four toner powder images which make up a composite color powder image. That composite color powder image is comprised of individual toner particles which have charge potentials which vary widely. Indeed, some of those particles have a positive charge. Transferring such a composite toner layer onto a substrate would result in a degraded final image. Therefore it is necessary to prepare the charges on the toner layer for transfer. This preparation is performed during a fifth cycle.

The fifth cycle begins by passing the image area once again past the erase station A. At erase station A the erase lamp 18 discharges the image area to a relatively low voltage level. This reduces the potentials of the image area, including that of the composite color powder images, to potentials near zero. The image area with its composite color powder image then passes once again to the charging station B. During the fifth cycle the charging station B performs a pretransfer charging function. The first charging device supplies sufficient negative ions to the image area so that substantially all of the previously positively charged toner particles are reversed in polarity.

As the image area continues in its travel past the first charging station B a substrate 38 is advanced into place over the image area using a sheet feeder (which is not shown). As the image area and substrate continue their travel they pass through the charging station C.

At charging station C the second charging device 22 applies positive ions onto the exposed surface of the substrate 38. The positive ions attract the negatively charged toner particles on the image area to the substrate. As the substrate continues its travel the substrate passes a bias transfer roll 40 which assists in attracting the toner particles to the substrate and in separating the substrate with its composite color powder image from the photoreceptor belt 10. The substrate is then directed into a fuser station I where a heated fuser roll 42 and a pressure roller 44 create a nip through which the substrate passes. The combination of pressure and heat at the nip causes the composite color toner image to fuse into the substrate 38. After fusing, a chute, not shown, guides the support sheets 38 to a catch tray, also not shown, for removal by an operator.

After the substrate is separated from the photoreceptor belt 10 the image area continues its travel and eventually enters a cleaning station J. At cleaning station J a cleaning blade 48 is brought into contact with the image area. The cleaning blade wipes residual toner particles from the image area. The image area then passes once again to the erase station A and the 5 cycle printing process begins again.

It is to be understood that while the figures and the above description illustrate the present invention, they are exemplary only. For example, the embodiment described above is a five cycle machine. While the principles of the present invention are perfectly well suited for use in such machines, they are also well suited for use in other types of machines, such as the more common four cycle architectures. Furthermore, others who are skilled in the applicable arts will recognize numerous modifications and adaptations of the illustrated embodiments which will remain within the principles of the present invention. Therefore, the present invention is to be limited only by the appended claims.

What is claimed is:

1. A printing machine, comprised of:

a photoreceptor having a charge retentive surface dimensioned to hold a plurality of image areas;

a charging station for charging a first image area to a potential that is to be determined;

an image data source for producing a digital representation of a latent image that is to be produced on said first image area;

an exposure station for exposing said first image area with said digital representation so as to produce a latent image;

a data interrogator for examining said digital representation to identify a solid unexposed section of said first image area; and an electrostatic voltmeter for measuring the potential of said solid unexposed section of said first image area after exposure;

wherein said potential of said solid unexposed section of said first image area is equated to the potential that is to be determined.

2. The printing machine according to claim 1, wherein said measured potential is used to adjust the charge on subsequent image areas such that the charge on at least one subsequent image area substantially has a predetermined magnitude.

* * * * *